US005667027A

United States Patent [19]

Poffenroth

[11] Patent Number: 5,667,027

[45] Date of Patent: Sep. 16, 1997

[54] DRILL STABILIZER

[75] Inventor: Ken D. Poffenroth, Edmonton, Canada

[73] Assignee: Argus Machine Co. Ltd., Edmonton, Canada

[21] Appl. No.: 539,604

[22] Filed: Oct. 5, 1995

[51] Int. Cl.[6] ..... E21B 17/10

[52] U.S. Cl. ..... 175/325.3

[58] Field of Search ..... 175/325.1, 325.3, 175/325.4, 325.5, 325.6

[56] References Cited

U.S. PATENT DOCUMENTS

| | | | |
|---|---|---|---|
| 4,082,373 | 4/1978 | Kellner | 175/325.3 |
| 5,174,391 | 12/1992 | Zijsling | 175/325.1 |

OTHER PUBLICATIONS

Drilco Industrial product brochure, pp. 18–22, U.S.A., at least as early as 1990.

Correct stabilizer use critical to wellbore, Jim Terry, Drilling Contractor Publication, Nov. 1981, pp. 100 and 102.

*Primary Examiner*—William P. Neuder

*Attorney, Agent, or Firm*—Anthony R. Lambert

[57] ABSTRACT

A drill stabilizer is formed of housing with a mandrel extending from the housing between a first shoulder and a second shoulder, the mandrel having a mandrel axis and an outer diameter adjacent the first shoulder, and at least three stabilizing rollers mounted sequentially along the mandrel between the first and second shoulders. Each stabilizing roller has an axis of rotation radially offset from the mandrel axis in an offset direction and distributed symmetrically around the mandrel axis. The diameter of each stabilizing roller is such that each stabilizing roller has a perimeter that extends further radially outward than the outer diameter of the housing in the offset direction of the respective stabilizing roller and does not extend further radially outward than the outer diameter in the direction opposite to the offset direction. Each stabilizing roller includes at least three slanted flutes distributed symmetrically about the perimeter of stabilizing roller and extending lengthwise along the stabilizing roller.

13 Claims, 3 Drawing Sheets

DRILL STABILIZER

FIELD OF THE INVENTION

This invention relates to stabilizers used in drilling for example during drilling of blastholes in mining operations and in other drilling such as oilfield drilling.

BACKGROUND OF THE INVENTION

Drill stabilizers are used in drilling of a hole to control the location of a drill bit in the hole.

An unsuccessful experiment was performed in the early 1980s in which a mining drill stabilizer was proposed and had limited use that had three rotationally offset stabilizing rollers mounted sequentially along a mandrel. The mining drill stabilizer was put into practise, and several were sold in Canada and the United States, but its use impeded drilling, and the experiment failed for want of an obvious way to improve the mining drill stabilizer and make it practical.

SUMMARY OF THE INVENTION

The inventor has identified that problems with the stabilizer related to the inability of the stabilizer to pass cuttings from the drill bit around the outside of the drill pipe past the stabilizer. It was not immediately apparent that this was the problem, due to the existing offset of the stabilizing rollers, nor that a solution could be provided. The inventor has however found that the provision of lengthwise flutes along the rollers avoids the problems found in the failed experiment, and permits cuttings to pass around the outside of the stabilizer.

Provision of helical flutes also helps draw or vaccuum out the cuttings from the ground, and pull the stabilizer into the ground to assist drilling.

There is therefore provided in accordance with one aspect of the invention, an improvement to the failed experiment that includes a housing with a mandrel portion extending from the housing between a first shoulder and a second shoulder, the mandrel having a mandrel axis and an outer diameter adjacent the first shoulder, at least three stabilizing rollers mounted sequentially along the mandrel between the first and second shoulders, each stabilizing roller having an axis of rotation radially offset from the mandrel axis in an offset direction and distributed symmetrically around the mandrel axis, the diameter of each stabilizing roller being such that each stabilizing roller has a perimeter that extends further radially outward than the outer diameter of the housing in the offset direction of the respective stabilizing roller and does not extend further radially outward than the outer diameter in the direction opposite to the offset direction; and each stabilizing roller including at least one flute, and preferably three flutes distributed symmetrically about the perimeter of stabilizing roller, extending lengthwise along the stabilizing roller.

The flutes, particularly three or more helical flutes, surprisingly overcome the difficulties associated with the failed experiment, and provides for an effectively stabilized drill pipe. In a test of a mining drill stabilizer according to the invention with three stabilizing rollers, each roller with four flutes at an angle of 10° and subtending an arc of about 60° as shown in section in FIG. 3, the mining drill stabilizer drilled 1½ times further than a conventional Drilco Industrial Model 63-B Roller Stabilizer and was still not as worn as the Model 63-B Roller Stabilizer.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

Figure 1:
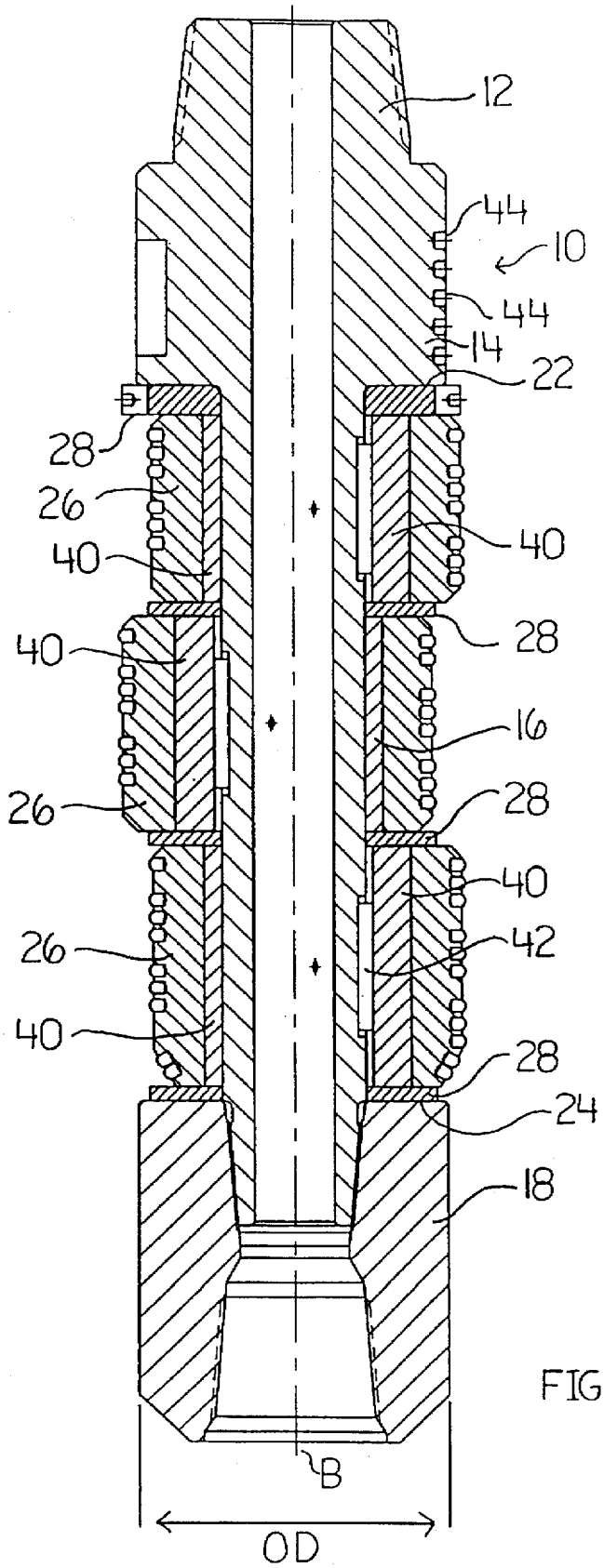
FIG. 1 is a longitudinal section through an embodiment of a drill stabilizer of the invention.
Figure 2:
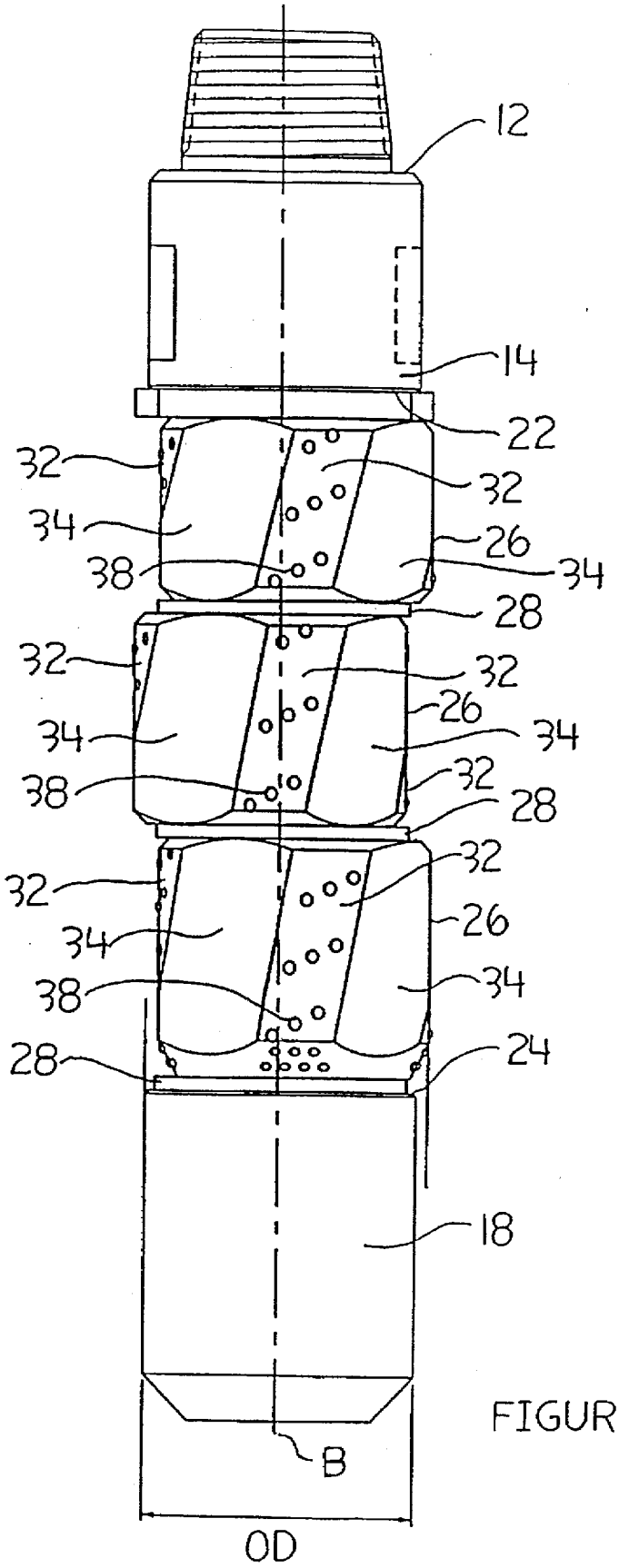
FIG. 2 is a side view of the drill stabilizer of FIG. 1.

Referring to the figures, there is shown a drill stabilizer 10 formed of a housing 12 with bottom sub 18. The upper end of the housing 12 and lower end of the bottom sub 18 are each threaded in conventional fashion for connection in a drill string (not shown) near a drill bit. The housing 12 has a top end 14 formed integrally with a mandrel 16 extending down from the top end 14 to a bottom sub 18 threaded onto the mandrel 16. The lower end of top end 14 terminates in a shoulder 22, and the upper end of bottom sub 18 terminates in a shoulder 24. The mandrel 16 extends between the shoulders 22 and 24. The outer diameter of the top end 14 is the same as the outer diameter of the bottom end 18. Alternatively, the top end 14 may be formed separately from the mandrel 16 and threaded together in a similar manner to the bottom sub 18.

Three stabilizing rollers 26 are mounted sequentially along the mandrel 16 between the first and second shoulders 22 and 24. Preferably, the stabilizing rollers are spaced from each other and the shoulders 22, 24 by spacers 28, with the top spacer 28 configured as a bushing pick-up.

Figure 4:
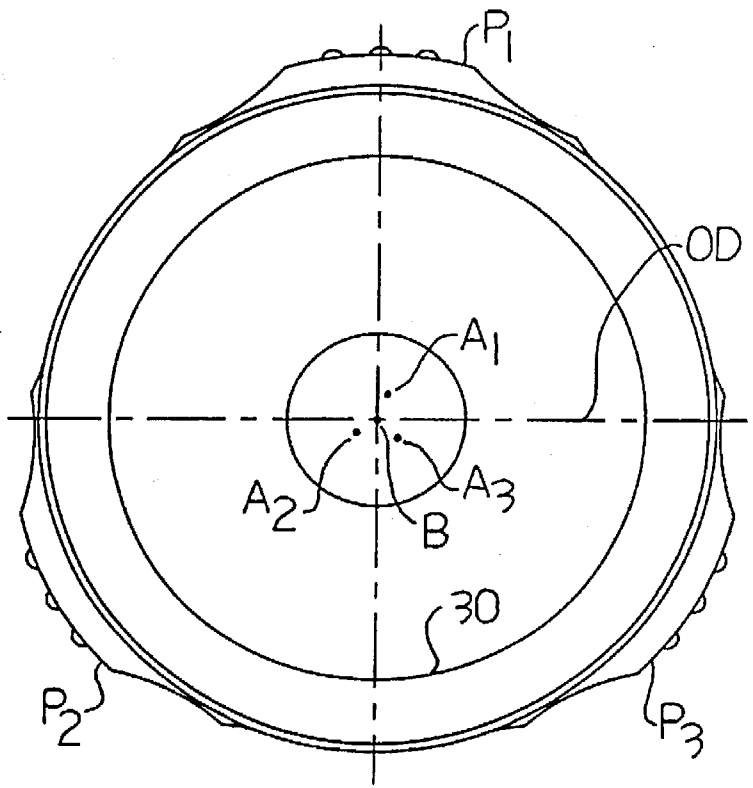
FIG. 4 is a top view of the drill stabilizer of FIG. 1 showing offset axes of the stabilizing rollers.
Figure 3:
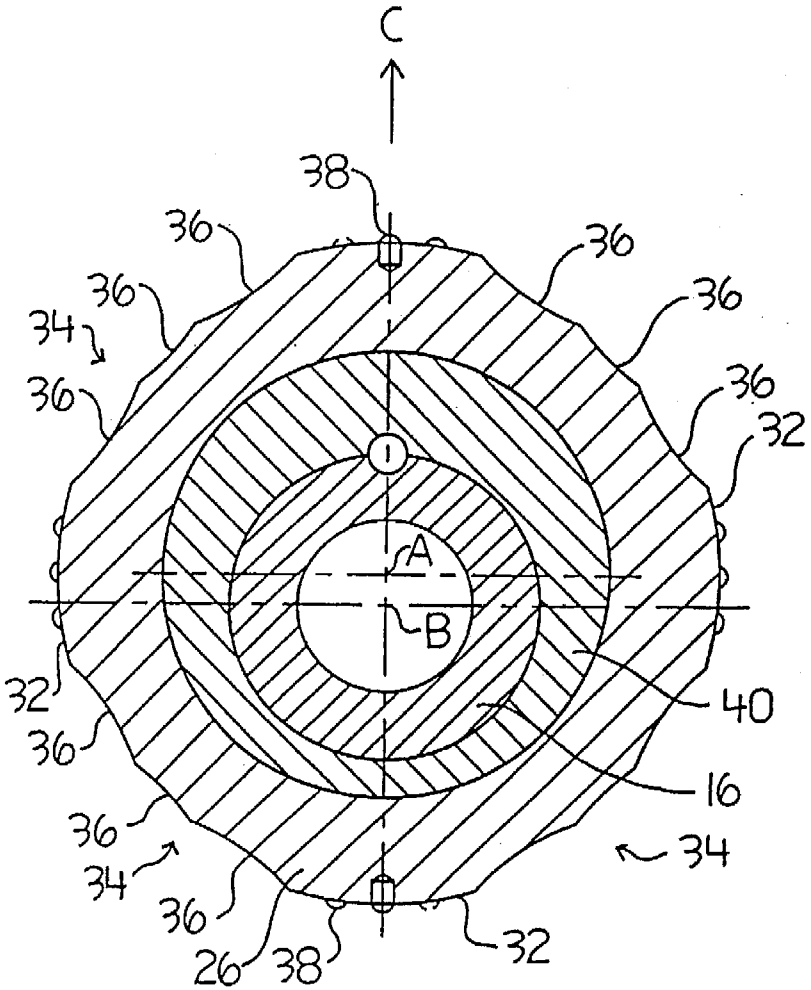
FIG. 3 is a cross-section through a stabilizing roller in the drill stabilizer of FIG. 1.

As shown best in FIG. 3, each stabilizing roller 26 has an axis of rotation A radially offset from the mandrel axis B in an offset direction C. The stabilizing rollers 26 are distributed symmetrically around the mandrel axis B as shown in FIG. 4 at about 120° apart. The offset of each axis $A_1$, $A_2$ and $A_3$ is about 10% of the radius of the housing (5% of OD). The diameter of each stabilizing roller 26 is such that each stabilizing roller has a perimeter 32 that extends further radially outward than the outer diameter OD of the housing in the offset direction C of that roller. The path of the perimeter 32 of each stabilizing roller 26 as the stabilizing roller 26 rotates is shown in FIG. 4. The path $P_1$ is for the roller 26 centered on axis $A_1$ and similarly for $P_2$ and $P_3$. On the opposite side from the direction C, the stabilizing roller 26 does not extend further radially outward than the outer diameter OD. The path of the perimeter of the stabilizing roller 26 with axis $A_1$ in the opposite direction to direction C is shown in dotted lines 30 in FIG. 4. The paths of the perimeters of the other stabilizing rollers is similar. The diameter of each stabilizing roller 26 is preferably substantially the same as the outer diameter OD of the housing 12.

Each stabilizing roller 26 includes at least three slanted flutes 34 (an embodiment with four is shown in FIGS. 1) distributed symmetrically about the perimeter 32 of stabilizing roller 26 and extending lengthwise along the stabilizing roller 26. As shown in FIG. 3, each flute 34 may be formed of several smaller flutes 36 each having a smaller radius of curvature. The perimeter 32 of each stabilizing roller 26 has embedded wear buttons 38, for example carbide dome top buttons. The top end 14 of housing 12 may include serrated carbide buttons 44.

As shown in FIG. 3, each stabilizer roller 26 is cylindrical and is mounted on an eccentric sleeve 40. The eccentric sleeves 40 are keyed to the mandrel 16 through locking pins 42 so that the eccentric sleeves 40 rotate with the mandrel. The bottom sub 18 is threaded onto the mandrel 16 until the spacers 28 are in compression, thus holding the spacers 28 and eccentric sleeves 40 and preventing their movement. During rotation of the drill pipe, only the rollers 26 move.

The drill stabilizer works as follows. As the drill pipe rotates, the mandrel rotates and the rollers rotate in the opposite direction to the mandrel. The flutes allow material to move upward in the hole being drilled and help force the stabilizer downward. At the same time, the rollers keep the drill bit centered in the hole and reduce wear on the drill bit.

It may be possible in some circumstances to have fewer flutes 34, such as one or two, but at least three are preferred, with the flutes 34 equally spaced around each roller 26. The successful trial of the mining drill stabilizer involved a tool with four flutes 34 at an angle of 10° with each flute subtending an angle of 60° as shown in FIG. 3. The angle of the flutes 34 to the axis of the tool, and the depth of the flutes, should be such that cuttings are allowed to move along the tool. If the angle of the flutes from the axis of the tool is near zero, few cuttings move. If the angle of the flutes is too great, such that the flutes form a tight spiral, the cuttings tend to have to move too far around the rollers, and again few cuttings move. An angle of about 10° has been found to be satisfactory for the flutes.

The drill stabilizer has applicability to other drilling operations such as oilwell drilling.

A person skilled in the art could make immaterial modifications to the invention described in this patent without departing from the essence of the invention.

The embodiments of the invention in which an exclusive property or privilege is claimed are defined as follows:

1. A drill stabilizer comprising:

a housing with a mandrel portion extending from the housing between a first shoulder and a second shoulder, the mandrel having a mandrel axis and an outer diameter adjacent the first shoulder;

at least three stabilizing rollers mounted sequentially along the mandrel between the first and second shoulders;

each stabilizing roller having an axis of rotation radially offset from the mandrel axis in an offset direction and distributed symmetrically around the mandrel axis;

the diameter of each stabilizing roller being such that each stabilizing roller has a perimeter that extends further radially outward than the outer diameter of the housing in the offset direction of the respective stabilizing roller and does not extend further radially outward than the outer diameter in the direction opposite to the offset direction; and each stabilizing roller including at least one flute extending lengthwise along the stabilizing roller.

2. The drill stabilizer of claim 1 in which each roller includes at least three flutes distributed symmetrically about the perimeter of the stabilizing roller and extending lengthwise along the stabilizing roller.

3. The drill stabilizer of claim 2 in which the flutes are slanted along the stabilizing roller to form a helical pattern of flutes.

4. The drill stabilizer of claim 3 in which each flute is formed of several smaller flutes.

5. The drill stabilizer of claim 4 in which the perimeter of each stabilizing roller has embedded wear buttons.

6. The drill stabilizer of claim 5 in which there are three stabilizer rollers each mounted 120° from the other.

7. The drill stabilizer of claim 3 in which each stabilizer roller is cylindrical and is mounted for rotation on an eccentric sleeve, each eccentric sleeve being keyed to the mandrel.

8. The drill stabilizer of claim 2 in which the diameter of each stabilizing roller is substantially the same as the outer diameter of the housing.

9. The drill stabilizer of claim 8 in which the flutes are slanted along the stabilizing roller to form a helical pattern of flutes.

10. The drill stabilizer of claim 9 in which each flute is formed of several smaller flutes.

11. The drill stabilizer of claim 2 in which the perimeter of each stabilizing roller has embedded wear buttons.

12. The drill stabilizer of claim 11 in which there are three stabilizer rollers each mounted 120° from the other.

13. The drill stabilizer of claim 8 in which each stabilizer roller is cylindrical and is mounted for rotation on an eccentric sleeve, each eccentric sleeve being keyed to the mandrel.

* * * * *